United States Patent [19]

Lange

[11] 4,011,426

[45] Mar. 8, 1977

[54] DEVICE WITH ARC-EXTINGUISHING SYSTEM

[76] Inventor: Emil Lange, 97, rue de Versailles, 92 Ville D'Avray (Hauts-de-Seine), France

[22] Filed: July 7, 1975

[21] Appl. No.: 593,313

Related U.S. Application Data

[63] Continuation of Ser. No. 289,256, Sept. 15, 1972, abandoned, which is a continuation-in-part of Ser. No. 670,666, Sept. 26, 1967

[30] Foreign Application Priority Data

Sept. 26, 1966 Germany ..... 5464466

[52] U.S. Cl. ..... 200/144 C; 200/149 A

[51] Int. Cl.[2] ..... H01H 33/02; H01H 9/30

[58] Field of Search ..... 200/144 C, 148 G, 149 A, 200/144 R, 149 R

[56] References Cited

UNITED STATES PATENTS 3,227,844 1/1966 Burrage et al. ..... 200/144 C 3,236,979 2/1966 Latour ..... 200/144 C

FOREIGN PATENTS OR APPLICATIONS 1,422,551 1/1965 France ..... 200/144 C

*Primary Examiner*—Robert S. Macon

*Attorney, Agent, or Firm*—Craig & Antonelli

[57] ABSTRACT

A device for extinguishing electric arcs, especially a circuit interrupter, in which electrodes and/or other parts are used for striking an arc during the circuit opening, which consist at least in part of metallic and non-metallic elements producing reaction products under the heat of the arc serving as arc-extinguishing media, and in which an additional non-metallic component for the reduction of the current is added or admixed to such electrodes or parts or is included in the form of auxiliary electrodes or parts for the same purpose; a preferred non-metallic component for reduction of the current is silicon dioxide ($SiO_2$).

21 Claims, 3 Drawing Figures

FIG. 1
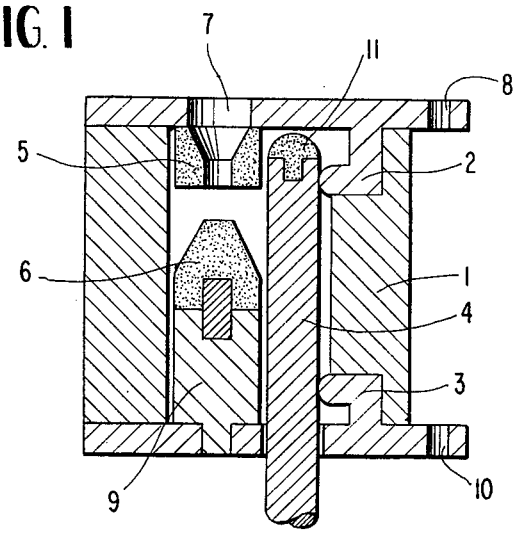
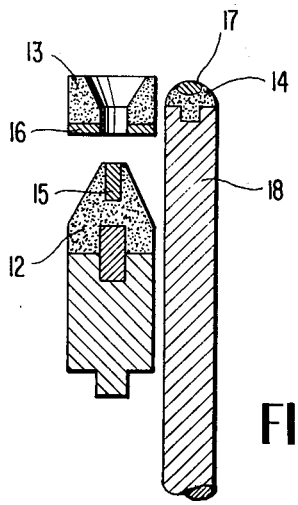
FIG. 2
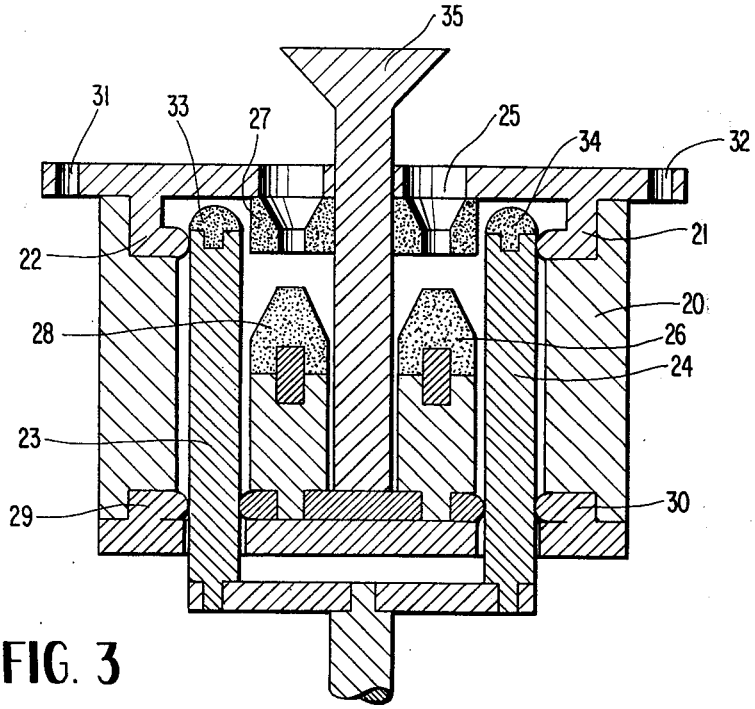
FIG. 3

DEVICE WITH ARC-EXTINGUISHING SYSTEM

CROSS REFERENCES TO RELATED APPLICATIONS

This is a continuation of U.S. application Ser. No. 289,256 filed Sept. 15, 1972, which is a continuation-in-part of U.S. application Ser. No. 670,666, filed Sept. 26, 1967.

The present invention relates to a device such as a circuit interrupter and the like provided with arc-extinguishing means designed to extinguish the electric arc which is struck during opening of the electric circuit.

Installations for the extinction of the electric arc, especially electrical interrupters have been proposed heretofore in which the electrodes or other parts, on which the electric arc burns, consist of a combination of metallic and non-metallic elements such as fluorine, sulfur or other suitable chemical compounds so that reaction products are given off by the electrodes in the gas phase or plasma phase as a result of the heat of the interrupting arc whereby arc-extinguishing compounds such as $SF_6$, etc., are formed by these reaction products.

On the one hand, these prior art electrodes possess a very good electrical conductivity owing to the metallic elements. On the other hand, it is achieved by the presence of the non-metallic components that a certain quantity of reaction products; namely, the arc-extinguishing compounds which form, for example, $SF_6$ are given off in the plasma phase or gas-phase by the electric-arc base points burning at the metallic elements.

These arc-extinguishing compounds, produced by the electric arc-base points are disposed directly in the electric arc axis and surround simultaneously also the electric arc column.

As a result of this direct interaction of the arc-extinguishing compounds, the electrons of the electric arc are captured already by the electrodes and are added to neutral molecules. The negative ions resulting therefrom have the same velocity as the positive ions and therefore recombine very readily with the same into neutral molecules. The current-carrying capacity of the electric arc distance is thereby reduced by this recombination between the electrically charged particles carrying the current flow whereby simultaneously the velocity of the dielectric strength between the eletrodes is increased after the arc extinction.

The operation of these prior art electrodes fulfills in every respect the prerequisites for the arc-extinction.

It has now been discovered that the current-carrying capacity of the electric arc distance during the extinguishing operation, and therewith the current to be interrupted can be still further reduced if the electrodes consist of a combination of any known metallic substances and a non-metal such as, for example, silicon dioxide ($SiO_2$) so that with certain constructive arrangements and electrical conditions, an arc extinction takes place.

The gases produced by the electric arc with the electrodes according to the present invention exhibit the same properties as air and therefore are not favorable for a flow of extinguishing medium for the purpose of arc extinction. The velocity of the dielectric strength between the electrodes is therefore very small after the arc extinction so that a re-ignition may readily occur.

In order to still further improve the operation and effectiveness of the electrodes for the production of electro-negative gases by the reduction of the current flowing during the extinguishing operation, the present invention proposes means which cause a reduction of the current by means of additional substances in the electrodes such as, for example, silicon dioxide ($SiO_2$).

This is achieved according to the present invention in that a further non-metallic substance such as silicon dioxide ($SiO_2$) is added or admixed to the electrodes consisting of a combination of metallic and non-metallic substances for the production of the arc-extinguishing compounds. It is thereby appropriate that an electrode consisting of metallic components and of silicon dioxide is arranged within the conventional electrode consisting of any known metallic and non-metallic components. However, with two mutually oppositely disposed electrodes, it is also possible to permit one of the electrodes (of conventional construction) to serve for giving off reaction products and for forming arc-extinguishing compounds ($SF_6$, etc.) whereas the other electrode (made in accordance with the present invention) consists of metallic components and of silicon dioxide or similar non-metallic material. With an arc-extinguishing chamber having two series-connected interrupting places, the electrode pair of one interrupting place serves advantageously for the giving off of reaction product by means of which the arc-extinguishing compounds such as $SF_6$, etc., are formed, whereas the other electrode pair consists of a combination of metallic substances and, for example, silicon dioxide or similar non-metallic material. Suitable binding agents such as, for example, epoxy resins, are appropriately used for the combination of the metallic and non-metallic components such as silicon dioxide of the present invention.

Accordingly, it is an object of the present invention to provide an arc-extinguishing device of the type described above which further improves the operating performance while at the same time eliminating the drawbacks encountered with the prior art constructions.

Another object of the present invention resides in a circuit interrupter having an arc-extinguishing means which permits a further reduction in the current-carrying capacity of the electric-arc dimension during the extinguishing operation.

Still a further object of the present invention resides in an arc-extinguishing device, especially for circuit interrupters, circuit breakers and the like, which retains fully the advantages obtained with the prior art devices while at the same time utilizing auxiliary materials and/or structures further enhancing its operation and effectiveness.

These and further objects, features, and advantages of the present invention will become more obvious from the following description when taken in connection with the accompanying drawing which shows, for purposes of illustration only, several embodiments in accordance with the present invention, and wherein:

FIG. 1 is a somewhat schematic, cross-sectional view through a first embodiment of an extinguishing chamber with electrodes in accordance with the present invention, which consist of a combination of metallic and non-metallic substances or materials whose reaction products form arc-extinguishing compounds whereby a further non-metallic substance such as, for example, silicon dioxide is added or admixed to these combinations.

FIG. 2 is a somewhat schematic, partial cross-sectional view through a modified embodiment of an arc-extinguishing device of the present invention, illustrating only the electrodes together with the tripping pin whereby auxiliary electrodes made from a combination of metallic elements and non-metallic substances and, for example, silicon dioxide are inserted into the electrodes consisting of conventional metallic and non-metallic components which form the arc-extinguishing compounds by the reaction products thereof as well as also into the tripping pin; and FIG. 3 is a somewhat schematic, cross-sectional view through a still further modified embodiment of an arc-extinguishing chamber with two series-connected interrupting places, consisting of a conventional electrode pair for the production of the arc-extinguishing compounds and a further electrode pair which consists of a combination of metallic elements and non-metallic elements such as silicon dioxide or the like in accordance with the instant invention.

Referring now to the drawing wherein like reference numerals are used throughout the various views to designate like parts, and more particularly to FIG. 1, reference numeral 1 designates therein an arc-extinguishing chamber within which is formed the interrupting place by the fixed contacts 2 and 3 and the tripping pin 4. The fixedly arranged electrodes 5 and 6 are arranged in parallel to this interrupting place which are electrically connected with the connecting or terminal pieces 8, 9 and 10. The hollow electrode 5 serves as discharge aperture. The tripping pin 4 possesses an electrode tip 11 by means of which the drawn arc is diverted to the electrodes 5 and 6.

The electrodes 5 and 6 and the tripping pin tip 11 consist of a combination of metallic and non-metallic elements of any known type or types for the formation of arc-extinguishing compounds and of silicon dioxide or of a similarly effective substance which serves for the current decrease and the arc extinction.

The proportions of the quantities of these three component elements—metallic and non-metallic substances or ingredients—for the production of the arc-extinguishing compounds and silicon dioxide ($SiO_2$) or similar material are so determined for a combination into a rigid electrode that, on the one hand, a good electrical conductivity exists (specific resistance smaller than 0.15 [Ohm ($mm^2/m$)]) and that during the extinguishing operation a sufficiently large quantity of arc-extinguishing compounds is split off or given off by the base points of the arc; however, on the other, that the current flowing therethrough is reduced by the effect of the silicon dioxide or similar material.

These three substances or ingredients are advantageously mixed together in powder-like condition and are combined into a rigid electrode by pressing together or casting together, etc.

In order to achieve the proper electrode conditions, it is necessary to combine these three elements into a coherent mass by a predetermined grain size so that the conditions for the electrical conductivity and for the arc-extinction operation are fulfilled.

The operation of the arc-extinction is as follows:

During opening of the interrupter an electric arc is drawn by the tripping pin 4 between the tripping pin tip 11 and the electrode 5. Since these electrodes 5 and 11 consist of a combination of the aforementioned three substances or ingredients, arc-extinguishing compounds are produced and the current flowing therethrough is reduced by the silicon dioxide present in the electrodes.

With a predetermined length and a predetermined, produced pressure increase, the electric arc jumps over to the electrode 6 in order to produce thereat under the same conditions, arc-extinguishing compounds and/or electronegative gases whereby the current reduction is maintained by the effect of the silicon dioxide.

The arc-extinction takes place under very favorable conditions due to the extinguishing medium and/or the electronegative gas flowing out under pressure whereby the electric arc burns at the electrode 5, and due to the current reduction resulting by the effect of the silicon dioxide.

The discharge of the extinguishing medium and/or of the electronegative gas may take place in a separate space so that the extinguishing chamber is completely closed and the produced electronegative gases are available for further arc-extinguishing operations.

In lieu of silicon dioxide, another substance with the same properties for the act-extinction may be utilized, such as, for example, alumina.

The electrodes of FIG. 2 are of two-stage construction in that separate auxiliary electrodes 15, 16 and 17 are arranged within the electrode bodies 12, 13 and 14, respectively.

The electrode bodies 12, 13 and 14 serve for the production of the arc-extinguishing compounds and/or of electronegative gases and again consist of any conventional, known combination of metallic and non-metallic components so that reaction products which form the arc-extinguishing compounds are given off by the heat of the electric arc. The auxiliary electrodes 15, 16 and 17 serve during the extinguishing operation for the purpose of current reduction and consist of a combination of a metallic component or material and silicon dioxide or the like.

The auxiliary electrodes 15, 16 and 17, consisting of metallic components and silicon dioxide with a conventional binding agent, such as, for example, epoxy resins, are appropriately manufactured in a separate process or operation by compressing or casting together at a predetermined temperature. The finished auxiliary electrodes are then compressed into an electrode by the compressing operation with the powder-like mixtures of the metallic and non-metallic substances or materials for the production of the arc-extinguishing compounds as can be seen from FIG. 2.

It is an advantage if the electrical conductivity of the auxiliary electrodes 15, 16 and 17 is larger than that of the electrodes 12, 13 and 14 giving off the arc-extinguishing compounds and/or electronegative gases.

It is achieved thereby that the base points of the electric arc burn on the auxiliary electrodes 15, 16 and 17; however, since these auxiliary electrodes 15, 16 and 17 are surrounded by the electrodes 12, 13 and 14 with a larger component of non-metallic components for giving off arc-extinguishing compounds and/or electronegative gases, a larger quantity of this arc-extinguishing medium is produced thereby.

In lieu of the auxiliary electrodes, it is also possible within the scope of the present invention to place the electrode 12, without auxiliary electrode 15, opposite the counter-electrode 16.

In this case, the electrode 12 serves for the production of arc-extinguishing compounds and/or electronegative gases and the electrode 16 for the reduction of the current.

In FIG. 3, two series-connected interrupting places are arranged in the extinguishing chamber 20 which are formed by the fixed contacts 21 and 22, and the tripping pins 23 and 24.

The fixed electrodes 25, 26 and 27, 28 are arranged in parallel to these two interrupting places; the fixed electrodes 25, 26 and 27, 28 are in electrical connection with the tripping pins 23 and 24 by way of the sliding contacts 29 and 30, respectively.

The hollow electrodes 25, 27 which are electrically connected with the feed lines 31 and 32, serve simultaneously as discharge apertures.

The tripping pin tips 33 and 34 consist of the same material as the electrodes 25, 26 and 27, 28, respectively.

The two interrupting places arranged in the extinguishing chamber 20 are spatially separated by the wall 35 so that each interrupting place is independent of the other.

The electrodes 27, 28 and 33 consist of a combination of known metallic and non-metallic substances or materials so that only arc-extinguishing compounds and/or electronegative gases are produced at this interrupting place by the electric arc. Electrodes 25, 26 and 34 consist of a combination of metallic substances and silicon dioxide or similar material and serve essentially for the current reduction since the gases produced thereby essentially exhibit only the same properties as air and serve therefore for the purpose of arc extinction only under certain conditions.

The operation of the interrupter of FIG. 3 is as follows:

Electric arcs are drawn as a result of the separation of the two interrupting places by the two tripping pins 23, 24 and the fixed contacts 21, 22 whereby the bases of the arcs burn on the tripping pin tips 33, 34 and the electrodes 25, 27.

Each of these two arcs produces a pressure increase in its respective individual chamber.

A current-reduction is brought about by the electric arc which burns at the electrodes 34, 25 since these electrodes consist of a combination of metallic elements and non-metallic elements such as silicon dioxide. Arc-extinguishing compounds and/or electro-negative gases are produced by the arc between the electrodes 33, 27 since these electrodes consist of a combination of metallic and non-metallic substances by means of which the desired arc-extinguishing compounds are given off.

During the further movements of the tripping pins 23 and 24, the base points of the electric arcs are transferred to the electrodes 26 and 28 so that the electric arcs now continue to burn between the electrodes 27, 28 and 25, 26 under the same conditions.

An extraordinarily easy arc-extinction takes place as a result of the discharge of the arc-extinguishing compounds and/or electronegative gases which are under pressure whereby even the gas flow produced by the arc at the electrodes 24, 25 participates under certain circumstances.

While I have shown and described several embodiments in accordance with the present invention, it is understood that the same is not limited thereto but is susceptible of numerous changes and modifications as known to a person skilled in the art.

For example, without departing from the spirit of the present invention, the described electrodes and/or contacts may be utilized with all installations and apparatus (safety fuses, lightening arrestors, etc.), in which an arc is to be extinguished.

Moreover, without changing the present invention, electrodes or other parts for the drawing of arcs may be utilized for the installations of the extinction of electric arcs which consist of metallic substances and silicon dioxide or similar products.

Furthermore, the electrodes and/or the arc-drawing parts may be utilized in interrupting or switching devices in which no arc-extinguishing flow is utilized so that the extinction of the electric arc takes place exclusively by the burning of the base points of the electric arc in the mass of the electrodes and/or the arc-drawing parts.

The metallic components of the new electrodes can be combined with the non-metallic component by subjecting them to high pressure. It is however preferable to use as binding agent a curable artificial resin, for example, a phenol resin, urea resin, melamine resin or especially an epoxy resin. Suitable epoxy resins are the known types, as for example polyglycidyl ethers of polyphenols, such as bisphenol A. For the curing of the epoxy resins, hardeners of the common types may be used, such as polycarboxylic anhydrides or preferably aromatic, aliphatic or cycloaliphatic polyamines.

Examples for the manufacture of electrodes:

a. 30 parts by weight of quartz meal,
b. 44.0 parts by weight of nickel powder,
c. 10 parts by weight of a mixture of
   i. 6 parts by weight of polytetrafluorethylene powder (registered trade mark "TEFLON") and
   ii. 1 part by weight of powdered sulfur are thoroughly mixed with
d. 14.5 parts by weight of an impregnating resin mixture of
   an epoxy resin,
   a reactive diluent,
   curing agents, and
   a curing accelerator, this impregnating resin mixture consisting of i. 85 parts by weight of an epoxy resin which is liquid at room temperature and can be obtained by condensing epichlorohydrin with bis (para-hydroxyphenyl) dimethylmethane in the presence of an alkali and which contains 5.0–5.5 epoxide equivalents per kg, and
ii. 15 parts by weight of 1,4-butanedioldiglycidyl ether, (a reactive diluent for epoxy resins sold by CIBA-GEIGY under the tradename "Araldite RD-2"),
iii. 50 parts by weight of triethylenetetramine (a curing agent for epoxy resins sold by CIBA-GEIGY under the tradename "Hardener XY 951"),
iv. 50 parts by weight of 2,2-bis (4'-aminocyclohexyl) propane (a curing agent for epoxy resins sold by BASF under the tradename "Dicykan") and
v. 10 parts by weight of bis (para-hydroxyphenyl)-dimethylmethane (a well known curing accelerator for epoxy resins), the resulting moist mass is pounded into an electrode mould, the binding agent cured at 140° C for 15 minutes and the electrode removed from the mould when it has cooled.

The following modifications are possible:

Replace the quartz meal (silicon dioxide) by alumina or steatite;

Replace the polytetrafluorethylene powder by fluorspar (calcium fluoride);

Replace sulfur preferably by twice the quantity of ferric ammonium sulfate;

Replace the polytetrafluorethylene powder and the sulfur by fluorspar and preferably twice the quantity of ferric ammonium sulfate;

Replace the quartz meal, the polytetrafluroethylene powder and the sulfur by preferably twice the quantity of fluorspar and ferric ammonium sulfate;

Replace the quartz meal by alumina, and the sulfur and the polytetrafluorethylene powder by fluorspar;

Replace the quartz meal and the sulfur by barium sulfate and ferric ammonium sulfate;

Replace the quartz meal by dolomite powder (registered trade mark "MIKRODOL") and the sulfur by ferric ammonium sulfate;

Increase the nickel quantity to 60 to 65 parts by weight and replace the quartz meal, the polytetrafluorethylene powder and the sulfur by fluorspar.

The particulate substances (i.e. the materials described above in powder-like, grain-like, etc. form) should have an average particle size of about 2 to 5 $\mu$.

Thus, it is obvious that the present invention is not limited to the details shown and described herein, and I therefore do not wish to be limited thereto but intend to cover all such changes and modifications as are encompassed by the scope of the appended claims.

I claim:

1. A device for extinguishing electric arcs comprising:

a first electrode, and a second electrode wherein an electric arc burns between said first and second electrodes, said first electrode is composed of a metallic substance providing said first electrode with electrical conductivity, and a non-metallic substance having the property of giving off a volatile, arc extinguishing gas due to the heat of the electric arc, and said second electrode is composed of a metallic substance providing said second electrode with electrical conductivity, and a non-metallic inorganic substance having a melting point higher than the melting point of the non-metallic substance of which said first electrode is composed, said non-metallic inorganic substance having the property of reducing current flow while itself giving off no volatile arc-extinguishing gases.

2. A device according to claim 1, wherein said second electrode is further composed of a non-metallic substance having the property of giving off a volatile, arc extinguishing gas due to the heat of the electric arc.

3. A device according to claim 2, wherein said first electrode is further composed of a non-metallic inorganic substance having a melting point higher than the melting point of the non-metallic substance of which said first electrode is composed, and having the property of reducing current flow while itself giving off no volatile, arc-extinguishing gases.

4. A device according to claim 1, wherein said non-metallic inorganic substance is a substance selected from the group consisting of silicon dioxide, alumina, steatite, and dolomite.

5. A device according to claim 4, wherein said non-metallic substances are bound together by a cured artificial resin.

6. A device according to claim 5, wherein said resin is a cured epoxy resin.

7. A device according to claim 1, wherein said arc extinguishing gases include electronegative gases.

8. A device for extinguishing electric arcs comprising:

first and second electrodes displaceable with respect to one another with a first electric arc being established therebetween; and third and fourth electrodes displaceable with respect to one another with a second electric arc being established therebetween;

wherein each of said first and second electrodes is composed of a metallic substance providing said first and second electrodes with electrical conductivity, and a non-metallic substance having the property of giving off a volatile, arc extinguishing gas due to the heat of said first electric arc, and each of said third and fourth electrodes is composed of a metallic substance providing said third and fourth electrodes with electrical conductivity, and a non-metallic inorganic substance having a melting point higher than the melting point of the non-metallic substance of which said first and second electrodes are composed, said non-metallic inorganic substance having the property of reducing current flow while itself giving off no volatile, arc-extinguishing gases.

9. A device according to claim 8, wherein said first and third electrodes are displaceable with respect to said second and fourth electrodes, respectively, and further including fifth and sixth electrodes having the same composition as and disposed adjacent said second and fourth electrodes, respectively, and with respect to which said first and third electrodes are displaceable, so that upon movement of said first and third electrodes away from said second and fourth electrodes and toward said fifth and sixth electrodes, respectively, said first and second electric arcs are transferred from between said first and second electrodes and said third and fourth electrodes to between said first and fifth electrodes and said third and sixth electrodes.

10. A device for extinguishing electric arcs comprising first, second and third electrodes, said second electrode being displaceable with respect to said first and third electrodes, with an electric arc being established between said first and second electrodes when said second electrode is in the proximity of said first electrode and said electric arc being transferred from between said first and second electrodes to between said second and third electrodes when said second electrode is displaced away from the proximity of said first electrode to the proximity of said third electrode, and wherein a portion of each of said first, second and third electrodes is composed of a metallic substance providing said first, second and third electrodes with electrical conductivity, and a non-metallic substance having the property of giving off a volatile, arc-extiguishing gas due to the heat of said electric arc, and wherein a portion of at least one of said electrodes is composed of a metallic substance providing said at least one of said electrodes with electrical conductivity; and a non-metallic inorganic substance having a melting point higher than the melting point of said non-metallic substance, said non-metallic inorganic substance having the property of reducing current flow while itself giving off no volatile, arc-extinguishing gases.

11. A device according to claim 10, wherein said at least one of said electrodes comprises each of said first, second and third electrodes.

12. A device according to claim 10, wherein said at least one of said electrodes is only said first and second electrodes.

13. A device for extinguishing electric arcs comprising a first electrode, and a second electrode, wherein an electric arc burns between said first and second electrodes, said first electrode being composed of a solid mixture of a prescribed amount by weight of a non-metallic particulate substance which has the property of giving off a volatile, arc extinguishing gas due to the heat of said electric arc, a prescribed amount by weight of a metallic particulate substance providing said first electrode with electrical conductivity, and a prescribed amount by weight of a resin which binds said metallic and non-metallic particulate substances together to form said first electrode, and said second electrode being composed of a solid mixture of a prescribed amount by weight of a non-metallic inorganic particulate substance having a melting point higher than the non-metallic particulate substance of which said first electrode is composed and which has the property of reducing current flow, while itself giving off no volatile, arc-extinguishing gases due to the heat of said electric arc, a prescribed amount by weight of a metallic particulate substance providing said second electrode with electrical conductivity, and a prescribed amount by weight of a resin which binds said metallic and non-metallic inorganic particulate substances together to form said second electrode.

14. A device according to claim 13, wherein said solid mixture of which said second electrode is composed further contains a prescribed amount by weight of a non-metallic particulate substance which has the property of giving off a volatile, arc-extinguishing gas due to the heat of said electric arc.

15. A device according to claim 14, wherein the metallic particulate substance within at least one of the solid mixtures of which said first and second electrodes are composed is at least one selected from the group consisting of nickel, silver, copper and alloys thereof.

16. A device according to claim 14, wherein the non-metallic particulate substance, giving off a volatile, arc-extinguishing gas, within at least one of the solid mixtures of which said first and second electrodes are composed is at least one selected from the group consisting of polytetrafluorethylene powder, calcium fluoride, sulfur, ferric ammonium sulfate, and barium sulfate.

17. A device according to claim 14, wherein the non-metallic inorganic particulate substance within the solid mixture of which said second electrode is composed is one selected from the group consisting of quartz meal, alumina, steatite, and dolomite.

18. A device according to claim 15, wherein the non-metallic particulate substance, giving off a volatile, arc-extinguishing gas, within at least one of the solid mixtures of which said first and second electrodes are composed is at least one selected from the group consisting of polytetrafluoroethylene powder, calcium fluoride, sulfur, ferric ammonium sulfate, and barium sulfate.

19. A device according to claim 18, wherein the non-metallic inorganic particulate substance within the solid mixture of which said second electrode is composed is one selected from the group consisting of quartz meal, alumina, steatite, and dolomite.

20. A device according to claim 19, wherein said resin is one selected from the group consisting of phenol resin, urea resin, melamine resin and epoxy resin.

21. A device for extinguishing electric arcs comprising a first electrode, and a second electrode, wherein an electric arc burns between said first and second electrodes, said first electrode being composed of a solid mixture of 10 parts by weight of a non-metallic particulate substance which has the property of giving off a volatile, arc extinguishing gas due to the heat of said electric arc, 44 or 60–65 parts by weight of a metallic particulate substance providing said first electrode with electrical conductivity, and 14.5 parts by weight of a resin which binds said metallic and non-metallic particulate substances together to form said first electrode, and said second electrode being composed of a solid mixture of 30 parts by weight of a non-metallic inorganic particulate substance having a melting point higher than the non-metallic particulate substance of which said first electrode is composed and which has the property of reducing current flow, while itself giving off no volatile, arc-extinguishing gases due to the heat of said electric arc, 44 parts by weight of a metallic particulate substance providing said second electrode with electrical conductivity, 10 parts by weight of a non-metallic particulate substance which has the property of giving off a volatile, arc extinguishing gas due to the heat of said electric arc, and 14.5 parts by weight of a resin which binds said metallic and non-metallic inorganic particulate substances together to form said second electrode.

* * * * *